US006333301B1

(12) United States Patent
Kamiya

(10) Patent No.: US 6,333,301 B1
(45) **Date of Patent: *Dec. 25, 2001**

(54) ENVIRONMENTAL PROTECTION-TYPE PARTICULATE DETERGENT COMPOSITIONS

(75) Inventor: Akira Kamiya, 2-44, Misumi-cho, Chigasaki-shi, Kanagawa-ken (JP)

(73) Assignee: Akira Kamiya, Kanagawa-Ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/356,419

(22) Filed: Jul. 16, 1999

(30) Foreign Application Priority Data

Jul. 22, 1998 (JP) ..... 10-222302
Apr. 6, 1999 (JP) ..... 11-098763

(51) Int. Cl.[7] ..... C11D 17/00
(52) U.S. Cl. ..... 510/438; 510/320; 510/353; 510/361; 510/509; 510/530
(58) Field of Search ..... 510/441, 443, 510/438, 446, 463, 509, 530, 392, 320, 353, 361

(56) References Cited

U.S. PATENT DOCUMENTS 4,304,675 * 12/1981 Corey et al. ..... 252/91
4,581,153 * 4/1986 Trabitzsch et al. ..... 252/140
4,713,193 * 12/1987 Tai ..... 252/91
5,336,665 * 8/1994 Garner-Gray et al. ..... 512/4
5,470,509 * 11/1995 Pancheri ..... 252/544
5,648,328 * 7/1997 Angell et al. ..... 510/441
5,656,584 * 8/1997 Angell et al. ..... 510/441
5,981,450 * 11/1999 Fabry et al. ..... 510/127
6,136,778 * 10/2000 Kamiya ..... 510/463

FOREIGN PATENT DOCUMENTS 472398 3/1992 (JP) .

* cited by examiner

*Primary Examiner*—Bruce H. Hess
*Assistant Examiner*—Dawn L. Garrett
(74) *Attorney, Agent, or Firm*—Roylance, Abrams, Berdo & Goodman, L.L.P.

(57) ABSTRACT

An environmental protection-type aqueous detergent composition is provided, wherein enzymatic degradation effect is maximized and the use of surfactants is minimized.

Said environmental protection-type particulate detergent composition comprises (a) 0.1–10% by weight of one or more detergent components selected from the group consisting of essential oils and essential oil components isolated or synthesized from said essential oils, (b) (i) 0.1–10% by weight of an oily surfactant for solubilizing said detergent components during impregnation and (ii) 0–20% by weight of a particulate surfactant, (c) an enzyme and (d) 10–90% by weight of an expanding agent and/or an enzymatic activity promoter, wherein the weight ratio of said (a) to (b) ranges from 1:0.5 to 1:15 and said (a) is impregnated into said (d).

9 Claims, No Drawings

ENVIRONMENTAL PROTECTION-TYPE PARTICULATE DETERGENT COMPOSITIONS

BACKGROUND OF THE INVENTION

The present Invention claims the priority of Japanese Patent Application Nos. 10-222302 filed Jul. 22, 1998 and 11-98763 filed Apr. 6, 1999 which are incorporated herein by reference.

The present invention relates to environmental protection-type particulate detergent compositions comprising one or more detergent components selected from the group consisting of essential oils and essential oil components isolated or synthesized from said essential oils (hereinafter sometimes simply referred to as essential oil species), a surfactant and an enzyme, which are domestically useful as fabric detergents, tableware detergents, bath detergents especially for physically handicapped or senior people or for body care for women for cleaning off even the grime in pores, local skin-treating detergents for feet or the like, scale-removing detergents for removing scale on bathtubs made from any type of materials, detergents for the inside of bathwater boilers, mold-removing detergents, detergents for sanitary earthenware such as toilet bowls, and cleaners for drain pipes. They are also useful as exterior detergents for vehicles such as cars and trains or transport aircrafts such as airplanes, detergents for washing the exterior, floors, tiles, glasses or the like of buildings with water, detergents for tableware washers in restaurants or the like, detergents for washing kitchen apparatus, kitchenware, floors, gutters or the like with water, detergents for removing pesticides deposited on crops, and also industrially useful as refiners for vegetable fibers, wool or silk and raw skins or as deinking agents for paper pulp. In addition, they also serve as detergents capable of preventing drain pipes from being clogged with waste liquor discharged after the above types of cleaning.

As used herein, the term "particulate" means to include powder and sherbet.

Conventional detergents comprise a surfactant as a detergent component, In which are emulsified and dispersed polymers and fats deposited as soils and the emulsified and dispersed polymers and fats are separated from washes. Surfactant-based detergents containing an enzyme have also been manufactured and marketed. However, these products had important problems. Namely, the surfactant surrounds fats to prevent the enzyme from coming into contact with the fats, so that the ability of the enzyme to act on the fats to degrade them was significantly limited or lost by denaturation of protein. In relation to the recent burning issue of environmental protection, the use of detergents containing large amounts of surfactants means that the discharge thereof as domestic wastewater into rivers damages the environment by polluting rivers and seriously increases the load of clean water in water purification plants.

Especially, conventional surfactants were unfavorable from the viewpoint of environmental clarification because anionic surfactants inhibit enzymatic activity except for soaps and N-acylamino acid systems while cationic or zwitterionic surfactants are deposited on cell membranes of microorganisms and sometimes accompanied by other hazardous materials to kill aerobic microorganisms capable of cleaning the environment.

Recently, the presence of a disease called "chemical hypersensitivity" has been reported. This disease manifests itself to involve vegetative disorder, headache, melancholia, nausea, etc. when the total uptake of chemicals exceeds a certain level. Another disease called "sick house syndrome" has also been reported, which is caused by the interior air being contaminated with building materials or coatings in newly built or rebuilt houses. These diseases are caused by several tens of thousands or more types of chemicals produced.

Dirt on the skin or clothes include fats, sweat and dead keratin resulting from skin metabolism as well as minute chemicals contained in dust as described above, allergens and chemicals contained in skin detergents or rinses, hair-setting sprays, petroleum-based synthetic detergents for fabric or kitchen use and like daily products. These chemicals deposited on the skin are believed to cause atopic dermatitis. These minute chemicals penetrate into interstices between the epidermal keratin just before exfoliation and the underlying keratin to transcutaneously have an adverse influence on human bodies. Even those who have not developed atopic dermatitis or chemical hypersensitivity may show conditions thereof when the total uptake of chemicals exceeds a certain level.

Therefore, people of the present generation are required to remove these chemicals from the skin and clothes or to remove pesticides which have entered recesses on the surface of fruits or vegetables.

However, these chemicals which have entered into recesses can not be removed with surfactants alone. Petroleum surfactants used as kitchen detergents induce denaturation of protein to cause eczema in the people using them daily. Soaps consisting of fatty acid salts are not preferable for application to affected skin because of their alkalinity.

Conventional detergents for currently spread tableware washing machines employ strongly alkaline salts and chlorine bleaching agents to simultaneously attain solubilization of deposits and disinfection. Recently, strong alkalis have been replaced by weak alkalis for domestic use because they were frequently drunk by accident or caused hands to be rough. This led to the additional use of surfactants to supplement detergency. However, surfactants lather to adversely affect the environment so that less lathering surfactants have necessarily been chosen with low detergency causing hygienic problems such as insufficient cleaning or bacterial propagation. A solution was proposed to these problems by adding an enzyme or the like to supplement detergency. However, data show that enzymes are inhibited as evidenced by denaturation of protein with various types of surfactants derived from long-chain alkyl amines; polyoxyethylenes, hard alkylbenzene sulfonic acid salts, polyoxyethylene nonylphenyl ethers or the like derived from ethylene, propylene, butylene or the like; soft alkylbenzene sulfonic acid salts derived from gas oil or kerosine; olefin sulfonic acid salts or the like derived from heavy oil. Therefore, enzymatic degradation can not always be effective.

JPA No. 72398/92 discloses an advanced enzyme which is not inhibited by these surfactants. However, this disclosure can not satisfy detergency while solving environmental problems caused by discharge. This also applies to fabric detergents.

An object of the present invention is to solve said problems by maximizing enzymatic degradation effect while minimizing discharge of surfactants. We found that essential oils which have been known as perfumes and which are based on hydrocarbons, alcohols, esters or terpenoids and components thereof rapidly solubilize or disperse liquid or solid polymers and fats into emulsion, gel or cream, i.e.

convert them into emulsion, dispersion, gel, sol, cream or solution. If an enzyme exists there, the enzyme can readily come into contact with the solubilized fats, proteins and starches to remarkably increase the working area and rapidly degrade the fats or the like.

It is known that the moving ability of water molecules is increased with small clusters forming assemblies of the water molecules. Thus, the use of water formed of small clusters for washes during cleaning activates the penetration of water to increase the opportunity for each detergent component to act on the washes. Clusters can be reduced by adding the following materials:

1) bicarbonates, hydrogentartrates, hydrogenphosphates or the like, which comes into contact with water to generate hydroxide groups;
2) bicarbonates or the like, which generates carbon dioxide gas to agitate water, optionally in the presence of organic acids and salts thereof as foam-promoters;
3) sodium percarbonate and sodium perborate, which similarly act by generating foams of oxygen for an extended period;
4) sodium citrate, which similarly acts by binding to metal ions to soften water by chelating effect.

Alkaline materials such as carbonates, silicates and sulfates can be used to control the pH of enzymes within a range safe to humans from neutral to weakly alkali (which causes no denaturation of protein).

Experiments were made on degradation of fats by lipase in the existence of each of an aqueous sodium bicarbonate solution and an aqueous sodium carbonate solution in an amount equivalent to the fats. After the lapse of the same period past the addition of lipase, the degradation degrees were compared. In this case, the former showed degradation performance 10 times higher than that of the latter. Sodium bicarbonate is the best component as a particulate expanding agent and/or enzymatic activity promoter.

Essential oil species solubilized by surfactants in an environment of water formed of small clusters as described above rapidly penetrate into washes to efficiently dissolve fats so that enzymes contained therein move with water molecules to rapidly adsorb the washes and produce a sufficient amount of enzymatic activity.

As a result, the amount of surfactants used for dissolving fats deposited on washes can be remarkably reduced to attain a better detergent performance than obtained by such surfactants.

Thus, essential oils and essential oil components isolated or synthesized from said essential oils not only penetrate into and solubilize fats to enlarge the working area of fat-degrading enzymes but also disperse proteins and starches other than fats to increase the opportunity for the enzymes to act thereon up to 100%.

Detergent compositions of the present invention are defined as "environmental protection type" on the basis of the fact that any environmentally malignant surfactants are not used but environmentally friendly surfactants are used with minimum discharge and that essential oils and essential oil components isolated or synthesized from said essential oils evaporate after use to have no adverse effect on rivers or the like and are additionally capable of cleaning drain pipes with their active components after they are discharged as waste liquor. Moreover, detergent compositions of the present invention are harmless to humans and animals and environmentally friendly because they use naturally occurring materials or components synthesized therefrom. Thus, detergents of the present invention can be called green detergents.

SUMMARY OF THE INVENTION

According to the present invention, the role of surfactants as detergent components is minor or subsidiary. Namely, oily liquid surfactants function to solubilize essential oil species to help their impregnation into powders such as sodium bicarbonate, while powdery surfactants function as co-surfactants. In particulate detergent compositions of the present invention, surfactants are used in only an amount capable of solubilizing one or more detergents selected from the group consisting of essential oils and essential oil components isolated or synthesized from said essential oils in water, but are not used to emulsify polymers and fats. Therefore, the amount of surfactants used is extremely limited.

The present invention provides an environmental protection-type particulate detergent composition comprising (a) 0.1–10% by weight of one or more detergent components selected from the group consisting of essential oils and essential oil components isolated or synthesized from said essential oils, (b) (i) 0.1–10% by weight of an oily surfactant for solubilizing said detergent components during impregnation and (ii) 0–20% by weight of a particulate surfactant, (c) an enzyme and (d) 10–90% by weight of an expanding agent and/or an enzymatic activity promoter, wherein the weight ratio of said (a) to (b) ranges from 1:0.5 to 1:15 and said (a) is impregnated into said (d).

DETAILED DESCRIPTION OF THE INVENTION

Now, the above composition is described in detail.

As the particulate detergent composition of the present invention comes into contact with water during cleaning, the essential oil species must be solubilized in the resulting aqueous solution to function as detergents. If they were not solubilized, they would float on the surface of water like oils and be deposited on washes to rather contaminate them. Thus, the composition should have the ability to in situ solubilize essential oil species. For solubilizing the essential oil species, the composition should contain a proper amount of a surfactant with sufficient performance.

If the essential oil species simply penetrate a powder, they will evaporate to lower the detergency. Thus, the essential oil species, a non-volatile oily liquid readily solubilizing said essential oil species and a powder are mixed and spun at high speed to impregnate the powder with said essential oil species and said oily liquid. Normally, it is effective to mix the powder with the essential oil species preliminarily solubilized in the non-volatile oily liquid. If the total amount of the powder were added at once to a mixture of said essential oil species and oily liquid, a large-scaled stirring operation would be required, depending on the amount of the powder. However, it would be efficient and economic to partially impregnate the powder and then add and homogeneously mix the remaining powder. The detergent can be prepared in various forms adapted to the purpose and convenience of use ranging from free-flowing powder to sherbet dependent on the amount of the non-volatile oily liquid added.

The non-volatile oily liquid may include non-volatile polyhydric alcohols and fatty acid esters or the like so far as they can be readily solublized by a surfactant in aqueous solution. However, it would be efficient if the environmentally relatively safe and non-volatile oily liquid per se acts as a surfactant. Such non-volatile oily liquids include fatty acid nonionic surfactants, N-acylamino acid triethanolamine and lecithin. In addition to these oily liquids acting as surfactants, other surfactants serving as preservative for the enzyme and enhancing enzymatic activity in aqueous solution such as powdery N-acylamino acid can be added.

Among essential oils, it is economically efficient to use turpentine oil, pine oil, orange oil and other abundantly available ones. From the viewpoint of recycling waste, woody and citrous systems are preferable.

Suitable essential oil components isolated or synthesized from essential oils include alcohols such as citronellol, geraniol, nerol, linalool, α-, β- or γ-terpineol and terpinen-4-ol; hydrocarbons such as β-myrcene, α- and β- pinenes, limonenes, α- and γ-terpinenes and terpinolene; esters such as geranyl acetate, linalyl acetate and bornyl acetate; ethers; aldehydes; ketones and phenols. These isolated or synthesized components can be used alone or in combination. In the present invention, terpene alcohols, terpene hydrocarbons and essential oil esters are preferably selected in view of the safety based on the pharmacological aspect of the essential oil components.

Essential oil components are more convenient than essential oils per se, which have varying compositions dependent on the place or year of production.

One or more detergent components (a) selected from the group consisting of essential oils and essential oil components isolated or synthesized from said essential oils are used in the amount of 0.1–10 by weight, preferably 0.5–5.0% by weight on the basis of the weight of a particulate detergent composition. In this case, said oily surfactant (b) (i) is used in the amount of 0.1–10% by weight, preferably 0.5–5.0% by weight, while said particulate surfactant (b) (ii) is used in the amount of 0–20% by weight, preferably 1.0–10.0% by weight. However, the weight ratio of said (a) to (b) ranges from 1:0.5 to 1:15. Preferred ranges are 1:2 to 1:10 for fabric detergents, 1:3 to 1:12 for tableware detergents and 1:1 to 1:6 for body shampoos. These weight ratios indicate that much smaller amounts of surfactants are required than conventional products.

Preferred surfactants used in the present invention to solubilize one or more components selected from the group consisting of essential oils and essential oil components isolated or synthesized from said essential oils used in the present invention are $C_6$–$C_{18}$ fatty acid nonionic surfactants such as caproic acid (−3.4° C.), caprylic acid (16.50° C.), capric acid (31.3° C.), lauric acid (44.8° C.), myristic acid (54.1° C.), palmitic acid (62.7° C.), stearic acid (69.6° C.), oleic acid (16.2° C.), linoleic acid (−5.0° C.) and linolenic acid (−11.0° C.), especially because they are oily and do not inhibit enzymatic activity. In view of the oiliness, it is preferable to use a fatty acid such as caproic acid, caprylic acid, capric acid, oleic acid, linoleic acid and linolenic acid alone, or a mixture of natural coconut fatty acids which are liquid at normal temperatures (including caproic acid, caprylic acid, capric acid, lauric acid and myristic acid) or various fatty acids, such as mixed fatty acids based on oleic acid.

Surfactants used in the present invention include nonionics such as liquid $C_6$–$C_{18}$ fatty acid nonionic surfactants, including glycerin fatty acid esters [mono-, di- or tri-esters of each fatty acid (caproic acid, caprylic acid, capric acid, oleic acid, linoleic acid and linolenic acid) with glycerin; these esters are liquid at normal temperatures]; polyglycerin fatty acid esters such as di-, tri-, tetra-, hexa- or deca-glycerin fatty acid esters [mono-, di-, tri-, penta- hepta- or deca-esters of each fatty acid (caproic acid, caprylic acid, capric acid, lauric acid, myristic acid, oleic acid, linoleic acid and linolenic acid) with polyglycerin; these esters are liquid at normal temperatures]; sorbitan fatty acid esters [mono-, sesqui- or trimesters of each fatty acid (caproic acid, caprylic acid, capric acid, lauric acid, oleic acid, linoleic acid and linolenic acid) with sorbitan; these esters are liquid at normal temperatures]; sucrose fatty acid esters [for example, sucrose cocoate (liquid at normal temperatures)]; and fatty acid alkylolamides [for example, coconut fatty acid diethanolamide (liquid at normal temperatures), diethanolamide oleate (liquid at normal temperatures), coconut fatty acid monoethanolamide and coconut fatty acid triethanolamide]. Polyoxyethylene-based nonionic surfactants containing ethylene oxides may also be used, but are inappropriate as solubilizers for particulates because they are oxidized and deteriorated in the air.

Suitable anionic surfactants include $C_6$–$C_{18}$ fatty acid anionic surfactants such as N-acylamino acid triethanolamines including triethanolamine N-cocoyl DL-alanine, triethanolamine N-cocoyl-L-glutamate and triethanolamine N-lauroyl glutamate.

Naturally derived lecithin or the like may also be used.

N-acyl L-glutamic acid salts (sodium salt or potassium salt) are advantageously used as auxiliary particulate surfactants for keeping the shelf stability of particulate enzymes. Specifically, sodium N-cocoyl L-glutamate and potassium N-cocoyl L-glutamate are suitable for solubilization at low temperatures, and stearic acid and the like are suitable for solubilization at high temperatures. Natural saponin can be added. This promotes the effect of cleaning drain pipes or grease traps with waste wash liquor. Surfactants used in the present invention are safely in vivo metabolized and neither induce denaturation of protein nor inhibit enzymatic activity.

Fatty acid esters such as polyoxyethylene glycerin fatty acid esters, polyoxyethylene sorbitan fatty acid esters and polyoxyethylene sorbitol fatty acid esters; esters of a petroleum-derived glycol such as propylene glycol or polyethylene glycol with a fatty acid; fatty acid esters of a fatty acid with polyethylene glycol obtained by addition polymerization of a fatty alcohol with ethylene oxide may also be used, but ethylene oxide systems are inappropriate for particulate detergents normally in contact with the air because they are deteriorated.

Enzymes which can be used in the present invention include lipase, protease, amylase and cellulose, which may be used alone or in combination. Lipase is used mainly for washing tableware and fabrics, while protease is used mainly for washing the body. Enzymes can be used in the present invention at 20–100 U/g (dry soiling) for lipase, 20–100 U/g (dry soiling) for amylase and 20–100 U/g (dry soiling) for protease on the basis of the weight of a particulate detergent composition.

A major component of particulate detergent compositions of the present invention is an expanding agent and/or enzymatic activity promoter such as bicarbonates, particularly sodium bicarbonate. Sodium bicarbonate has an expanding effect and an enzymatic activity promoting effect, and shows weak alkalinity which does not exceed pH 8.5 even if it is used in large amounts. It is also environmentally safe and has high detergency. In addition, expanding agents for washes and soils per se selected from the group consisting of percarbonates, perborates, persulfates, hydrogenphosphates and hydrogentartrates may be combined. Specific compounds include sodium percarbonate, sodium bicarbonate or sodium perborate. Sodium bicarbonate can be used in the amount of 10–90% by weight, preferably 30–80% by weight on the basis of the weight of a particulate detergent composition.

Particulate detergent compositions of the present invention may also contain a citrate as a chelating agent. This chelating agent acts to sequester metal ions in water to activate water molecules and promote enzymatic activity. Suitable citrates include sodium salt or potassium salt or the like, preferably sodium citrate, which not only acts as described above but also acts as a blowing agent by reacting with a bicarbonate or the like to promote penetration into washes. Succinates, caseinates, polyphosphates, metaphosphates or the like can be used in addition to or in place of citrates. Disodium ethylenediaminetetraacetate, disodium calcium ethylenediaminetetraacetate and the like are unpreferable because they inhibit enzymatic activity. Phosphates are also unpreferable in view of the prevention of eutrophication of rivers and seas.

Compositions of the present invention may also contain a pH adjustor selected from the group consisting of organic acids such as malic acid, citric acid, fumaric acid, succinic acid; carbonates such as sodium carbonate; silicates such as sodium silicate; and sulfates such as sodium sulfate. The pH in solution of particulate detergent compositions of the present invention is not limited, but preferably weakly acid to weakly alkali in the range which allows enzymes to effectively work. This pH adjustor is used in the amount of 0.1–10% by weight, preferably 0.5–5% by weight on the basis of the weight of a particulate detergent composition to maintain the pH of the aqueous solution at 7.5–8.5 during use.

The following examples further illustrate the present invention without, however, limiting the same thereto.

EXAMPLE

Example 1

In a 200 ml beaker were added 1 g of an essential oil component linalool and 5 g of coconut fatty acid diethanolamide (available from Kawaken Fine Chemicals Co., Ltd.) to form an oily mixture, into which 25.0 g of powder of sodium bicarbonate was added and the mixture was spun at high speed for 5 minutes in a domestic mixer to impregnate the powder with the oily mixture. The impregnated powder was combined with 3.0 g of pancreatin (composite enzyme for digesting proteins, starches and fats, available from Amano Pharmaceutical Co., Ltd.), 5.0 g of Amisoft (sodium N-cocoyl L-glutamate, available from Ajinomoto Co., Inc.) and 10 g of powder of sodium citrate, and sodium bicarbonate was further added to 100 g to give a particulate detergent. Water was added to this detergent to give 100 ml of an aqueous solution, from which 2 ml was taken and added to 10 g of lard solidified in another 200 ml beaker and stirred. After standing for 30 minutes, the solubilization state of the lard was visually observed. The lard was found to be totally homogeneously solubilized. To further confirm the solubilization state, the lard was cooled to 5° C. and observed again. The lard was finely divided and could not be solidified again. Results are shown in Table 1.

Examples 2–39

Powder detergents were prepared and tested in the same manner as described in Example 1. Results are shown in Tables 1–6.

TABLE 1

| | Examples | | | | | | |
|---|---|---|---|---|---|---|---|
| Components | 1 | 2 | 3 | 4 | 5 | 6 | 7 |
| Linalool | 1.0 | | | | | | |
| α-Terpineol | | 1.0 | | | | | |
| Geraniol | | | 1.0 | | | | |
| Terpinen-4-ol | | | | 1.0 | | | |
| α-Pinene | | | | | 1.0 | | |
| d-Limonene | | | | | | 1.0 | |
| Terpinene | | | | | | | 1.0 |
| Pancreatin corre sponding to 300 u | 0.1 | 0.1 | 0.1 | 0.1 | 0.1 | 0.1 | 0.1 |
| Sodium bicarbonate (for impregnation) | 25.0 | 25.0 | 25.0 | 25.0 | 25.0 | 25.0 | 25.0 |
| Coconut fatty acid diethanolamide (for impregnation) | 1.0 | 2.0 | 3.0 | 4.0 | 5.0 | 1.0 | 2.0 |
| Sodium perborate | | 10.0 | 10.0 | | 10.0 | 10.0 | |
| Sodium citrate | | | 10.0 | | | 10.0 | |
| Sodium N-cocoyl L-glutamate | 9.0 | 8.0 | 7.0 | 6.0 | 5.0 | | |
| Sodium N-myristoyl L-glutamate | | | | | | 9.0 | 8.0 |
| Sodium bicarbonate | to 100 g | to 100 g | to 100 g | to 100 g | to 100 g | to 100 g | to 100 g |
| State of lard after standing for 30 minutes | AAA | AAA | AAA | AAA | AAA | AAA | AAA |

State of lard: AAA: completely solubilized; AAa: nearly homogeneously solubilized; AA: non-homogeneously solubilized; A: insufficiently solubilized; X: not solubilized.

TABLE 2

| | Examples | | | | | |
|---|---|---|---|---|---|---|
| Components | 8 | 9 | 10 | 11 | 12 | 13 |
| Geranyl acetate | 1.0 | | | | | |
| Linalyl acetate | | 1.0 | | | | |
| Bornyl acetate | | | 1.0 | | | |
| Turpentine oil | | | | 1.0 | | |
| Pine oil | | | | | 1.0 | |
| Orange oil | | | | | | 1.0 |
| Pancreatin corre-sponding to 300 u | 0.1 | 0.1 | 0.1 | 0.1 | 0.1 | 0.1 |
| Sodium bicarbonate (for impregnation) | 25.0 | 25.0 | 25.0 | 25.0 | 25.0 | 25.0 |
| Coconut fatty acid diethanolamide (for impregnation) | 3.0 | 4.0 | 5.0 | 1.0 | 1.0 | 1.0 |
| Sodium perborate | 10.0 | 10.0 | | 10.0 | 10.0 | |
| Sodium citrate | | 10.0 | | | 10.0 | |
| Sodium N-myristoyl L-glutamate | 7.0 | 6.0 | 5.0 | | | |
| Potassium N-lauroyl L-glutamate | | | | 9.0 | 8.0 | 7.0 |
| Sodium bicarbonate | to 100 g | to 100 g | to 100 g | to 100 g | to 100 g | to 100 g |
| State of lard after standing for 30 minutes | AAA | AAA | AAA | AAA | AAA | AAA |

State of lard: AAA: completely solubilized; AAa: nearly homogeneously solubilized; AA: non-homogeneously solubilized; A: insufficiently solubilized; X: not solubilized.

TABLE 3

| Components | Examples 14 | 15 | 16 | 17 | 18 | 19 | 20 |
|---|---|---|---|---|---|---|---|
| Linalool | 2.0 | | | | | | |
| α-Terpineol | | 3.0 | | | | | |
| Geraniol | | | 4.0 | | | | |
| Terpinen-4-ol | | | | 5.0 | | | |
| α-Pinene | | | | | 2.0 | | |
| d-Limonene | | | | | | 3.0 | |
| Terpinene | | | | | | | 4.0 |
| Pancreatin corresponding to 300 u | 0.1 | 0.1 | 0.1 | 0.1 | 0.1 | 0.1 | 0.1 |
| Sodium bicarbonate (for impregnation) | 50.0 | 50.0 | 50.0 | 50.0 | 50.0 | 50.0 | 50.0 |
| Glycerin oleate (for impregnation) | 2.0 | | | 5.0 | | | 4.0 |
| Sorbitan cocoate (for impregnation) | | 3.0 | | | 4.0 | | |
| Sucrose cocoate (for impregnation) | | | 4.0 | | | 3.0 | |
| Sodium citrate | | | 10.0 | | | 10.0 | |
| Sodium N-cocoyl L-glutamate | 7.0 | 4.0 | 2.0 | | 4.0 | 2.0 | |
| Sodium bicarbonate | to 100 g | to 100 g | to 100 g | to 100 g | to 100 g | to 100 g | to 100 g |
| State of lard after standing for 30 minutes | AAA | AAA | AAA | AAA | AAA | AAA | AAA |

State of lard: AAA: completely solubilized; AAa: nearly homogeneously solubilized; AA: non-homogeneously solubilized; A: insufficiently solubilized; X: not solubilized.

TABLE 4

| Components | Examples 8 | 9 | 10 | 11 | 12 | 13 |
|---|---|---|---|---|---|---|
| Geranyl acetate | 5.0 | | | | | |
| Linalyl acetate | | 2.0 | | | | |
| Bornyl acetate | | | 3.0 | | | |
| Turpentine oil | | | | 4.0 | | |
| Pine oil | | | | | 5.0 | |
| Orange oil | | | | | | 2.0 |
| Pancreatin corresponding to 300 u | 0.1 | 0.1 | 0.1 | 0.1 | 0.1 | 0.1 |
| Sodium bicarbonate (for impregnation) | 50.0 | 50.0 | 50.0 | 50.0 | 50.0 | 50.0 |
| Glycerin oleate (for impregnation) | | | 3.0 | | | 4.0 |
| Sorbitan cocoate (for impregnation) | 5.0 | | | 4.0 | | |
| Sucrose cocoate (for impregnation) | | 4.0 | | | 5.0 | |
| Sodium citrate | | 10.0 | | | 10.0 | |
| Sodium N-myristoyl L-glutamate | | 4.0 | | | | |
| Potassium N-lauroyl L-glutamate | | | | | | 2.0 |
| Sodium myristate (soap) | | | | 2.0 | | |
| Sodium bicarbonate | to 100 g | to 100 g | to 100 g | to 100 g | to 100 g | to 100 g |
| State of lard after standing for 30 minutes | AAA | AAA | AAA | AAA | AAA | AAA |

State of lard: AAA: completely solubilized; AAa: nearly homogeneously solubilized; AA: non-homogeneously solubilized; A: insufficiently solubilized; X: not solubilized.

TABLE 5

| Components | Examples 27 | 28 | 29 | 30 | 31 | 32 | 33 |
|---|---|---|---|---|---|---|---|
| α-Pinene | 2.0 | 2.0 | 2.0 | 2.0 | | | |
| α-Terpineol | | | | | 2.0 | 2.0 | 2.0 |
| Lipase corresponding to 300 u | 0.1 | 0.1 | 0.1 | 0.1 | 0.1 | 0.1 | 0.1 |
| Sodium bicarbonate (for impregnation) | 25.0 | 25.0 | 25.0 | 25.0 | 25.0 | 25.0 | 25.0 |
| Coconut fatty acid diethanolamide (for impregnation) | 2.0 | 2.0 | 2.0 | 2.0 | 2.0 | 2.0 | 2.0 |
| Sodium N-cocoyl L-glutamate | 3.0 | | | | 3.0 | | |
| Sodium N-myristoyl L-glutamate | | 3.0 | | | | 3.0 | |
| Sodium myristate | | | 3.0 | | | | 3.0 |
| Sodium myristyl sulfate | | | | 3.0 | | | |
| Sodium bicarbonate | to 100 g | to 100 g | to 100 g | to 100 g | to 100 g | to 100 g | to 100 g |
| State of lard afterstanding for 30 minutes | AAA | AAA | AAA | AAA | AAA | AAA | AAA |

State of lard: AAA: completely solubilized; AAa: nearly homogeneously solubilized; AA: non-homogeneously solubilized; A: insufficiently solubilized; X: not solubilized.

TABLE 6

| Components | Examples 34 | 35 | 36 | 37 | 38 | 39 |
|---|---|---|---|---|---|---|
| α-Terpineol | 2.0 | | | | | |
| Linalyl acetate | | 2.0 | 2.0 | 2.0 | 2.0 | 2.0 |
| Lipase corresponding to 300 u | 0.1 | 0.1 | 0.1 | 0.1 | 0.1 | 0.1 |
| Sodium bicarbonate (for impregnation) | 25.0 | 25.0 | 25.0 | 25.0 | 25.0 | 25.0 |
| Coconut fatty acid diethanolamide (for impregnation) | 2.0 | 2.0 | 2.0 | 2.0 | 2.0 | 2.0 |
| Sodium N-cocoyl L-glutamate | | 3.0 | | | | |
| Sodium N-myristoyl L-glutamate | | | 3.0 | | | |
| Sodium myristate | | | | 3.0 | | |
| Sodium myristyl sulfate | 3.0 | | | | 3.0 | |
| Sodium linear alkylbenzene sulfonate | | | | | | 3.0 |
| Sodium bicarbonate | to 100 g | to 100 g | to 100 g | to 100 g | to 100 g | to 100 g |
| State of lard after standing for 30 minutes | AAA | AAA | AAA | AAA | AAA | AAA |

State of lard: AAA: completely solubilized; AAa: nearly homogeneously solubilized; AA: non-homogeneously dispersed; A: insufficiently solubilized; X: not solubilized.

Comparative examples 1 and 2 and Examples 40 and 41

Each of the following conventional powder detergents was used in the amount of 2.3 g per 4 kg of washes: (1) powdered soap available from the Union of Cooperative Societies (pure soap content 60%; main component: sodium fatty acid) (Comparative example 1) and (2) Top available from Lion Corporation (surfactant content 34%; main components: sodium a-sulfonic fatty acid ester, linear alkyl benzene system, sodium fatty acid; auxiliaries:

aluminosilicates, carbonates, enzymes, fluorescent agent) (Comparative example 2).

Powdered detergents having the formulations shown in Table 7 according to the present invention were used.

TABLE 7

| | Examples | |
|---|---|---|
| | 40 | 41 |
| α-Pinene | 1.0 | |
| α-Terpineol | | 1.0 |
| Sodium bicarbonate (for adjustment of bulk) | to 100 g | to 100 g |
| Sodium citrate | 10.0 | 10.0 |
| Enzyme-based bleaching agent | 10.0 | 10.0 |
| Lipase | 1000 u | 1000 u |
| Amylase | 300 u | 300 u |
| Protease | 300 u | 300 u |
| Coconut fatty acid diethanolamide (for impregnation as a solubilizer for essential oil components, available from Kawaken Fine Chemicals Co., Ltd.) | 5.0 | 5.0 |
| Amisoft (sodium N-myristoyl L-glutamate, available from Ajinomoto Co., Inc.) | 4.0 | |
| Sodium myristate | 1.0 | 5.0 |
| Surfactants (% by weight) | 10 | 10 |

Comparative results of these detergents are shown in Table 8.

TABLE 8

| | Comparative Examples | | Examples | |
|---|---|---|---|---|
| | 1 | 2 | 40 | 41 |
| Loading (g) | 2.3 | 2.3 | 1.15 | 1.15 |
| Number of rinses | 2 | 2 | 1 | 1 |
| Amount of surfactants (g) | 1.38 | 0.69 | 0.115 | 0.115 |
| Alikalinity in solution (pH) | Weakly basic | Weakly basic | Neutral | Neutral |
| Evaluation | o | o | o | o |

○: After cleaning for 10 minutes, soil was completely removed to show a detergent effect.

The results showed that:

1) surfactants could be reduced to or be less than 1/12 of the pure soap of Comparative example 1 or 1/6 of Comparative example 2; and 2) the number of rinses could be reduced to ½.

ADVANTAGES OF THE INVENTION

According to the present invention, enzymatic degradation effect can be maximized and discharge of surfactants can be minimized. Namely, relatively environmentally friendly surfactants can be used instead of environmentally malignant surfactants and the discharge amount can be minimized. Essential oils and essential oil components isolated or synthesized from said essential oils evaporate after use without adversely affecting rivers or the like.

Particulate detergent compositions of the present invention neither stimulate the skin, nor kill naturally occurring aerobic microorganisms, nor inhibit enzymatic activity contained therein, because they are weakly basic to weakly acidic in solution in water. They can avoid the need of using different detergents for cotton and wool as previously.

One or more detergent components selected from the group consisting of essential oils and essential oil components isolated or synthesized from said essential oils used in the present invention avoid the necessity of further bactericidal operations because they can maintain hygiene by their bactericidal effect when washing fabric or tableware. They also have the advantage that drain pipes can be cleaned with waste wash liquor flowing through the drain pipes to help hygienic control thereof. They also have antiseptic and anticorrosive effects.

Detergent compositions for washing fabrics according to the present invention in aqueous solution are very close to neutrality because they are at or less than pH 8. This avoids the need to use different detergents for washing cotton and wool.

What is claimed is:

1. An environmentally friendly particulate detergent composition comprising (a) 0.1–10% by weight of one or more detergent components selected from the group consisting of α-pinenes, β-pinenes, limonenes, terpinenes, linalool, geraniol, α-, β- or γ-terpincol, terpinen-4-ol, geranyl acetate, bornyl acetate, linalyl acetate and mixtures thereof, said detergent components being present in an amount effective to solubilize fats, (b) (i) 0.1–10% by weight of an oily surfactant selected from the group consisting of liquid $C_6$-$C_{18}$, fatty acid nonionic surfactants and liquid N-acylamino acid triethanolamines wherein the acyl group is an alkyl group containing 6 to 18 carbon atoms, and (ii) 0–20% by weight of a powdery surfactant of a N-acylamino acid salt wherein the acyl group is an alkyl group containing 6 to 18 carbon atoms, said powdery surfactant functioning as a co-surfactant, (c) an enzyme, and (d) 10–90% by weight of a particulate expanding agent or enzymatic activity promoter or mixtures thereof, wherein the weight ratio of said (a) to (b) ranges from 1:0.5 to 1:15 and said detergent component (a) is impregnated into said component (d), and wherein said oily surfactant is included in an amount effective to solubilize said detergent components to help their impregnation into said component (d).

2. The environmentally friendly particulate detergent composition of claim 1, wherein said enzyme is selected from the group consisting of lipase, protease, amylase, cellulase and mixtures thereof.

3. The environmentally friendly particulate detergent composition of claim 1, wherein said expanding agent or enzymatic activity promoter is selected from the group consisting of sodium bicarbonate, sodium percarbonate, sodium citrate, sodium perborate, and mixtures thereof.

4. The environmentally friendly particulate detergent composition of claim 1, wherein said N-acylamino acid salt is a sodium salt or a potassium salt.

5. The environmentally friendly particulate detergent composition of claim 1, wherein said N-acylamino acid salt is selected from the group consisting of sodium N-acyl L-glutamate and potassium N-acyl L-glutamate.

6. The environmentally friendly particulate detergent composition of claim 5, wherein said sodium N-acyl L-glutamate is selected from the group consisting of sodium N-cocoyl L-glutamate and sodium N-myristoyl L-glutamate.

7. The environmentally friendly particulate detergent composition of claim 1, wherein said oily surfactant is selected from the group consisting of glycerin oleate, sorbitan cocoate, sucrose cocoate and coconut fatty acid diethanolamide.

8. An environmentally friendly particulate detergent composition comprising:

(a) 0.1–10% by weight of one or more detergent components selected from the group consisting of α-pinenes, β-pinenes, limonenes, and mixtures thereof, said detergent components being present in an amount to solubilize fats, (b) (i) 0.1–10% by weight of an oily surfactant selected from the group consisting of sucrose fatty acid esters and liquid N-acylamino acid triethanolamines wherein the acyl group is an alkyl group containing 6 to 18 carbon atoms, and (ii) 0–20% by weight of a powdery surfactant of a N-acylamino acid salt wherein the acyl group has the formula RCO-, where R is an alkyl group containing 6 to 18 carbon atoms, said powdery surfactant functioning as a co-surfactant, (c) an enzyme selected from the group consisting of lipase, protease, amylase, cellulase, and mixtures thereof, and (d) 10–90% by weight of a particulate expanding agent or enzymatic activity promoter comprising sodium bicarbonate, wherein the weight ratio of said (a) to (b) ranges from 1:0.5 to 1:15 and wherein said detergent composition is prepared by the steps of solubilizing component (a) in component (b) and thereafter impregnating the resulting mixture of component (a) and component (b) into component (d), and wherein said oily surfactant is included in an amount to solubilize said detergent components to help their impregnation into said component (d).

9. An environmentally friendly particulate detergent composition comprising:

a mixture of (a) 0.1–10% by weight of one or more detergent components selected from the group consisting of α-pinenes, β-pinenes, limonenes, and mixtures thereof, said detergent components being present in an amount to solubilize fats, and (b) (i) 0.1–10% by weight of an oily surfactant selected from the group consisting of sucrose fatty acid esters and liquid N-acylamino acid triethanolamines wherein the acyl group has the formula RCO-where R is an alkyl group having 6 to 18 carbon atoms, and (b) (ii) 0–20% by weight of a powdery surfactant of a N-acylamino acid salt wherein the acyl group is an alkyl group containing 6 to 18 carbon atoms, said powdery surfactant functioning as a co-surfactant, said component (a) being dispersed in component (b) and said components (a) and (b) being combined in a weight ratio of 1:0.5 to 1:15, (c) an enzyme selected from the group consisting of lipase, protease, amylase, cellulase, and mixtures thereof, and (d) 10–90% by weight of a particulate expanding agent or enzymatic activity promoter comprising sodium bicarbonate, wherein said mixture of said (a) and (b) is impregnated in said component (d), and wherein said oily surfactant is present in an amount to solubilize said detergent components to impregnate said mixture into said component (d).

* * * * *